US006189358B1

(12) United States Patent
Fanchini et al.

(10) Patent No.: US 6,189,358 B1
(45) Date of Patent: Feb. 20, 2001

(54) TWO STAND TANDEM FOR ROLLING LINE

(75) Inventors: Bernardo Fanchini, Genoa; Cesare Gualco, Novi Ligure, both of (IT)

(73) Assignee: Danieli & C. Officine Meccaniche SpA, Buttrio (IT)

( * ) Notice: Under 35 U.S.C. 154(b), the term of this patent shall be extended for 0 days.

(21) Appl. No.: 09/423,831

(22) PCT Filed: May 14, 1998

(86) PCT No.: PCT/IB98/00730

§ 371 Date: Nov. 16, 1999

§ 102(e) Date: Nov. 16, 1999

(87) PCT Pub. No.: WO98/51423

PCT Pub. Date: Nov. 19, 1998

(30) Foreign Application Priority Data

May 16, 1997 (IT) ..... 97A0093

(51) Int. Cl.[7] ..... B21B 43/16; B21B 45/02

(52) U.S. Cl. ..... 72/229; 72/43; 72/41

(58) Field of Search ..... 72/41, 42, 43, 72/229

(56) References Cited

U.S. PATENT DOCUMENTS 4,950,415 * 8/1990 Malito ..... 72/42
5,746,081 * 5/1998 Klamma et al. ..... 72/229

FOREIGN PATENT DOCUMENTS 57-156809 * 9/1982 (JP) .

* cited by examiner

*Primary Examiner*—Rodney A. Butler
(74) *Attorney, Agent, or Firm*—Antonelli, Terry, Stout & Kraus, LLP

(57) ABSTRACT

A tandem with two reversible four-high rolling stands (14*a*, 14*b*) for the cold rolling of thin strip to 0.18 mm, advantageously from 0.18 to 1.2 mm, includes at least a first (12*a*) and a second (12*b*) drawing reel, mans to heat the rolls and the lubricating oils, a control and command unit, and a first lubrication system (17), the working rolls (15) being associated with replacement rolls (115), the stands (14*a*, 14*b*) including a first working condition with the working rolls (15) and at least a second working condition with the replacement rolls (115). Below the stands (14*a*, 14*b*) there is a first (20*a*) and a second (20*b*) collection tank to collect the lubrication fluid, there also being a second finishing lubrication system (18) which can be activated in alternation with the first system (17). Each of the first (20*a*) and second (20*b*) collection equipped with switching unit (21) whose command unit (22) are controlled by the command and control unit (31), each of the a switch (21) being equipped with at least two ways (30*a*, 30*b*) which can be activated in alternation, a first (28*a*) and a second (28*b*) containing reservoir tank cooperating respectively with a first (24*a*) and a second (24*b*) circulation pump, each of the pumps (24*a*, 24*b*) feeding the respective first (17) and second (18) lubrication system.

8 Claims, 1 Drawing Sheet

TWO STAND TANDEM FOR ROLLING LINE

FIELD OF APPLICATION

This invention concerns a tandem with two rolling stands employed in a rolling line to cold roll thin strips.

The tandem to which the invention refers consists of a pair of four-high rolling stands, of the reversible type, cooperating with at least one reel upstream and at least one reel downstream and suitable to produce up to 650÷750,000 tonnes per year of cold rolled thin strip.

In this invention, cold rolled thin strip or sheet should be taken to mean a strip of 0.18 mm or more in thickness, from 0.18 to 3 mm, advantageously from 0.18 to 1.2 mm; the invention has been conceived and designed to solve the considerable problems related to this type of extremely thin strip.

STATE OF THE ART

Tandems of four-high reversible rolling stands are employed at present to cold roll strip which normally has a minimum thickness of 1.2÷1.5 mm.

Below these values of minimum thickness the surface quality which can be obtained from the hot rolling mill which produces the strip is not such as to allow the rolling of lesser thicknesses.

The basic process normally includes a winding reel which first feeds the tandem with a hot rolled product of the appropriate thickness and the cold rolled product leaving the tandem is wound onto a first drawing reel.

From this first drawing reel the product is made to pass again, in the opposite direction, into the tandem and, following a further cold reduction, is wound onto a second drawing reel.

The two passes achieve a usual reduction of 50÷60%.

In order to obtain a further reduction there follows a possible final cold rolling pass.

With these passes it is not possible to go below certain values of thickness as the surface quality of the product which they are able to supply is poor and unsatisfactory.

This is because the working rolls which perform the final reduction pass no longer have the necessary surface quality in that the surface quality has deteriorated in the passes which precede the final pass.

One solution to this problem is proposed in DE-A-4310063, which describes a tandem with two four-high reversible rolling stands served by winding reels upstream and downstream.

This document provides that the last finishing pass is performed by specific finishing rolls, arranged in a stand-by position during the working cycle, which replace the working rolls used for the first reduction passes by means of a rapid change-over of the rolls performed by the apposite device.

This document makes no reference either to the thicknesses of the finished product obtained or to the lubrication systems or organs associated with the rolling stands.

JP-A-57156809 describes a reversible rolling mill with a single stand which includes a substantially unified lubrication system; the concentration of oil in the lubrication mixture is adjusted from time to time, according to the specific reduction pass which is to be carried out, by means of a complicated control system.

In any case, lubrication liquids with a high and low concentration are mixed together, so that the adjustment carried out by the control system, apart from being complex also risks being not very precise.

FR-A-2 533 467 describes a method for producing a strip in a single pass cold rolling mill with five stands, in which the last stand has special working rolls and a separate lubrication system.

JP-A-61052901 describes a method for producing a metallic strip in a rolling line comprising a first reversible stand having large-diameter work rolls and a second reversible stand having small-diameter rolls.

Each of these stands has an indipendent lubrication system.

These documents don't solve any one of the above cited problems regarding the reduction in the obtainable strip thickness and the increase in the resulting quality of the strip surface.

The purpose of this invention therefore is to obtain very thin strip using a rolling lubricant which is always coherent with the specific reduction passes.

To be more exact, a different lubricant is used between the initial reduction passes and the finishing passes, using an adjustment system which is extremely simplified and rapid in switching from one lubricant to the other coherent with the change in type of rolling.

The present applicant has designed, tested and embodied this invention to obtain this and other advantages compared to the state of the art.

DISCLOSURE OF THE INVENTION

The invention is set forth and characterised in the main claim, while the dependent claims describe variants of the idea of the main embodiment.

According to the invention, the reversible four-high rolling stands no longer receive motion directly in the working rolls, but in the respective back-up rolls.

This solution is already known per se from DE-A-4310063 where the back-up rolls are fed with motion in that the working rolls travel at the speed of the product being rolled, and do not cause any rubbing on the said product, given that their specific function is to ensure the highest surface quality to the product.

Feeding the back-up rolls instead of the working rolls also serves to assist and accelerate the change-over of the working rolls themselves; in this way, there can be two types of working roll, a first type for cold rolling to achieve an initial reduction, and a second type for cold rolling with a last pass, which achieves the surface finish.

According to the invention, the working rolls of the four-high reversible stands are equipped with sliders which cooperate with adjacent and substantially coaxial sliders which carry the replacement working rolls.

In this way, while the desired working rolls are introduced in a manner known to the state of the art, it is easy to expel the working rolls already present, and whose surface is already partly worn by the initial reduction passes, and vice versa.

According to the invention, the reversible stands are equipped with a double lubrication system; one system is associated with a first type of working roll, for example with a type of roll for cold rolling with substantial reductions in thickness, and the other system associated with the other type of working roll, for example the type used for cold rolling finishing.

Moreover, according to the invention, each of the two lubrication systems has its own containing reservoir tank connected to the collection tanks by means of its own switching valve means.

The containing reservoir tanks, in cooperation with their own specific pump means, serve to feed the respective feed conduits to send the lubricant to the strip being rolled.

In this way, the two lubrication systems are completely independent, there is no mixing of different types of liquid, and they can operate alternately, since the respective switching valve means are governed by a command and control unit which allows the functioning of the two systems to be inverted without any pause or downtimes whatsoever, and in a manner which is functionally correlated with the type of rolling pass being made.

The command and control unit is centralised and also manages, moment by moment, the adjustment of the concentration and the physical/chemical characteristics of the lubrication liquid, independently for the two systems, according to the rolling pass and also the technological and processing parameters such as the type of material, the final thickness required, any processes undergone by the material upstream or downstream and so on.

According to a variant, the valve means have an emptying position to empty the respective collection tanks; this position is assumed during cleaning and maintenance operations.

According to another variant of the invention, downstream and upstream of the tandem of four-high reversible stands there are drawing devices which serve to discharge the drawing tension from the reels.

There are also the usual heating systems, control systems, systems to maintain the temperature of the rolls and the oils, measurement systems, and so on.

ILLUSTRATION OF THE DRAWINGS

The attached drawings are given as a non-restrictive example, and show a preferential embodiment of the invention as follows:

FIG. 1 shows an embodiment of the invention in diagram form;

FIG. 2 shows a system to change working rolls;

FIG. 3 shows the possible operational cycles.

Figure 1:
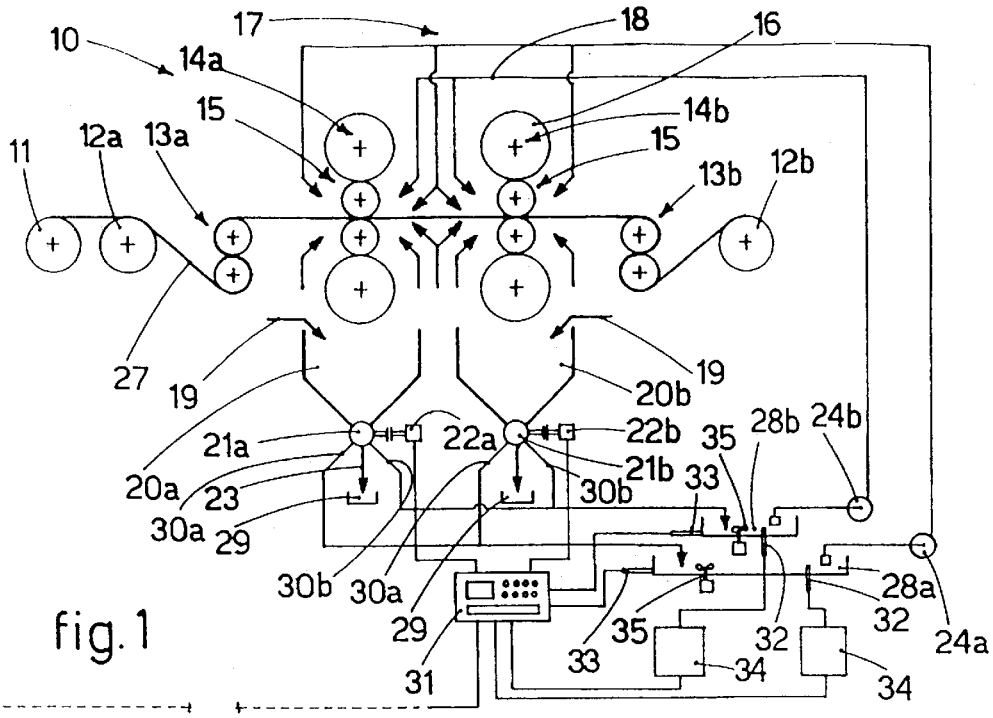
FIG. 1 shows a tandem 10 consisting of an unwinding reel 11, a first drawing reel 12*a,* a first drawing assembly 13*a,* a first four-high reversible stand 14*a,* a second four-high reversible stand 14*b,* a second drawing assembly 13*b* and a second drawing reel 12*b.*
Figure 2:
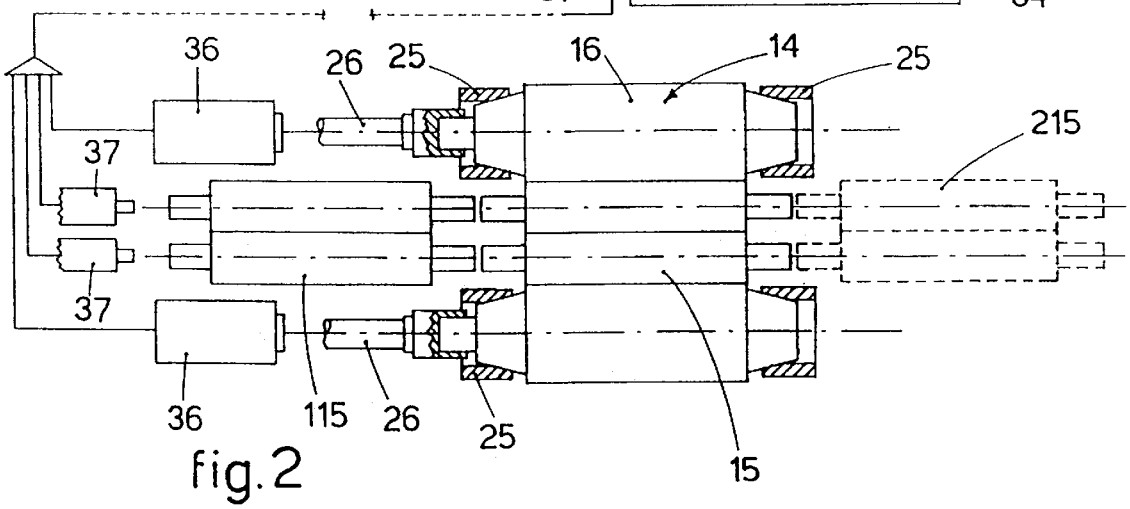

Heating means, oil temperature control means, means to control and maintain the temperature of the rolls, means to equalise the temperature of the strip, measuring means, governing means and so on are all included.

The unwinding reel 11, the first drawing assembly 13*a* and the second drawing assembly 13*b* are all optionals, each constituting as many variants.

The reversible stands 14*a* and 14*b* are equipped with a first normal lubrication system 17 and according to the invention are also equipped with a second finishing lubrication system 18.

The lubrication systems 17 and 18 operate above and below the cold rolled strip 27.

The lubrication systems 17 and 18, according to the invention, are both connected to a first 20*a* and a second 20*b* tank to collect the lubricant, respectively associated with the first 14*a* and second 14*b* four-high reversible stands.

The collection tanks 20*a* and 20*b* are equipped, in this case, with washing systems 19.

The bottom of the tanks 20*a* and 20*b* not only has the usual filter systems to trap and discharge impurities, it also has respective distributor valves 21*a* and 21*b*.

In this case, the distributor valves 21*a* and 21*b* are three way; of these, two 30*a* and 30*b* are respectively connected to the lubrication systems 17 and 18 by means of the specific containing reservoir tank 28*a* or 28*b,* and the third 23 is a discharge valve, for example when the tank is cleaned, and is connected with a common tank 29.

In this case, the distributor valves 21*a* and 21*b* are driven by command units 22, respectively 22*a* and 22*b,* governed by a centralised command and control unit 31 which manages and controls the overall working of the lubrication systems 17 and 18, correlating it to the rolling step and/or to the technological process being performed.

Each lubrication system 17 and 18 is equipped with circulation pumps 24, respectively 24*a* and 24*b*.

The lubrication liquid applied to the strip 27 being rolled is taken from the collection tanks 20*a* and 20*b* from whence it is sent, by means of the distributor valves 21*a* and 21*b,* to the specific containing reservoir tank, 28*a* or 28*b,* associated with the specific lubrication system 17 or 18.

In this way, it is guaranteed that there is no mixing of the lubrication liquids of the first 17 and second lubrication system.

Each containing reservoir tank 28*a* and 28*b* according to the invention is equipped with its own means 32 to control and restore the level of liquid, and also its own means 33 to control the composition of the lubrication liquid.

According to a variant, the means 33 to control the composition of the lubrication liquid are associated with means to at least partly restore the physical/chemical characteristics of the lubrication liquid such as tanks 34 with metering devices for substances such as lubricant oils, additives, inoculants, etc., the devices being suitable to intervene on the lubrication liquid and restore the characteristics thereof.

The means 32 to control and restore the level of liquid, the means 33 to control the composition of the liquid and the tanks 34 are governed by the command and control unit 31.

The command and control unit 31 manages the refilling of the containing reservoir tanks 28*a* and 28*b* in such a way as to guarantee, at every moment and for every specific step of the rolling cycle, the correct concentration and the correct physical/chemical characteristics of the lubrication liquid according to the type of material being rolled, the final thickness to be obtained, the type of processing to which the material being rolled has been subjected and other operating and technological parameters.

To this purpose, the command and control unit 31 coordinates at least the functioning of the distributor valves 21*a* and 21*b* and of the means 34 to restore the composition of the liquid so as to obtain the desired lubrication characteristics.

The command and control unit 31 also manages the activation of the motors 36 of the back-up rolls 16 and the actuators 37 which perform the change-over of the working rolls 15 when the specific reduction step requires it.

The centralised control by the command and control unit 31 ensures that the technological management of the rolling cycle and the management of the lubrication step are perfectly coordinated.

According to a further variant, the containing reservoir tanks 28*a* and 28*b* include their own stirrer means 35, governed by the command and control unit 31 and suitable to maintain the concentration of the lubrication liquid always uniform, avoiding any deposits and sediments.

When the lubrication system 17 is in use, the distributor valves 21*a* and 21*b* only have open the way 30*a* connected to the tank 28*a* which is connected to the delivery means of the system 17 by means of the relative pump 24*a*.

When the lubrication system 18 is in use, the distributor valves 21*a* and 21*b* only have open the way 30*b* connected to the tank 28*b* which is connected to the delivery means of the system 18 by means of the relative pump 24*b*.

In this way, there is no mixing of lubrication liquids of different types, so that the two systems 17 and 18 always work independently and autonomously from each other, and the change-over from one to the other takes place very quickly without any pause or downtime whatsoever and without losing any efficiency in the change-over time when the working rolls are being replaced or at any other moment defined by the rolling cycle.

In association with the lubrication systems 17 and 18, the usual accumulator assemblies, compensation assemblies, filter units, pressure control and adjustment units, discharge units, assemblies to control and adjust the rate of delivery, etc. are all included.

The drawing assemblies 13*a* and 13*b*, if included, serve to improve the control of the drawing action exerted on the strip 27 and at the same time to discharge the drawing action from the reels 12*a* and 12*b*.

The four-high reversible stands 14, respectively 14*a* and 14*b*, include back-up rolls 16 and working rolls 15; it is the back-up rolls 16 which receive motion from the motors 36, by means of brackets 26 which cooperate with the chocks 25.

The working rolls 15 can be translated axially on the appropriate sliders (not shown here) and with the suitable axial translation systems such as the actuators 37 shown in diagram form.

The pairs of working rolls 15 are associated with respective pairs of replacement rolls 115.

Figure 3:
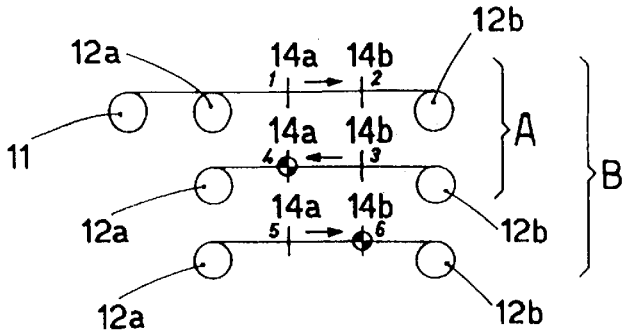

This means that in a normal working cycle (FIG. 3, cycle A) after the first three rolling steps respectively in the stands 14*a* (step 1), 14*b* (step 2) and again in 14*b* (step 3), the strip 27 passes into the last step consisting of the stand 14*a* (step 4).

The stand 14*a*, in this case, operates with the working rolls 15 in step 1, but in step 4 operates with the working rolls 115, while the working rolls 15 are "parked" in 215.

With regards to lubrication, in steps 1, 2 and 3 the normal lubrication system 17 is operative, whereas in step 4 the finishing lubrication system 18 is in operation, downstream of the penultimate stand 14.

In the working cycle suitable to obtain a greater finish, for products of a thickness of up to 0.18 mm, advantageously from 0.18 to 1.2 mm, with a maximum thickness which can be up to 3 mm, (FIG. 3, cycle B), steps 1÷5 are carried out with the usual rolls 15 and with the normal lubrication system 17.

In the last step, that is step 6, the reversible stand 14*b* operates with the replacement rolls 115 which are suitable for finishing and with the finishing lubrication system 18, which operates downstream of the penultimate stand 14 (FIG. 1), functioning.

What is claimed is:

1. Tandem with two reversible four-high rolling stands for the cold rolling of thin strip, comprising at least a first and a second drawing reel, heating means and means to maintain the temperature of the rolls and means to heat and maintain the temperature of lubrication fluid, a control and command unit, a first, lubrication system, back-up rolls associated with brackets which transmit motion, the stands including a first working condition in which the stands operate with working rolls and at least a second working condition in which the stands operate with replacement rolls, wherein below the stands there is a first and a second collection tank to collect the lubrication fluid, the tandem being characterised in that there is a second finishing lubrication system which is activated in alternation with the first system, the first and second collection tank comprising switching means whose relative command means are controlled by the command and control unit, each of the switching means being configured at least two ways in which it is activated alternately, a first and a second containing reservoir tank cooperating respectively with a first and a second circulation pump, each of the pumps feeding the respective first and second lubrication system.

2. Tandem with two stands as in claim 1, in which the first and second lubrication systems, with the command and control unit, are functionally associated respectively in the first working condition with the working rolls and in the second working condition with the replacement rolls.

3. Tandem with two stands as in claim 1, in which the working rolls and the replacement rolls are associated with sliders whose actuators are governed by the command and control unit.

4. Tandem with two stands as in claim 1, in which the containing reservoir tanks include means to control the level of lubrication fluid therein and means to restore the level of lubrication fluid therein governed by the command and control unit.

5. Tandem with two stands as in claim 4, in which the containing reservoir tanks include means to control the composition of the lubrication fluid governed by the command and control unit.

6. Tandem with two stands as in claim 4, in which the containing reservoir tanks include means to at least partly restore the composition of the lubrication fluid governed by the command and control unit.

7. Tandem with two stands as in claim 4, in which the containing reservoir tanks include means to stir and make the concentration of the lubrication fluid uniform, the means being governed by the command and control unit.

8. Tandem with two stands as in claim 6, in which the command and control unit governs at least the switching means and the means to at least partly restore the composition of the lubrication fluid according to the concentration and the physical/chemical characteristics of the lubrication fluid being obtained, moment by moment, correlated to the rolling step and the operating and technological parameters of the rolling cycle.

* * * * *